US010871728B1

(12) United States Patent
Ogishima et al.

(10) Patent No.: US 10,871,728 B1
(45) Date of Patent: Dec. 22, 2020

(54) CLEANING DEVICE HAVING A ROLLER SCRAPING MEMBER AND GUIDE PORTION

(71) Applicant: FUJI XEROX CO., LTD., Tokyo (JP)

(72) Inventors: Kazuya Ogishima, Kanagawa (JP); Sota Hara, Kanagawa (JP); Kazuhiro Saito, Kanagawa (JP); Yukihiro Ichiki, Kanagawa (JP); Hiroki Shiba, Kanagawa (JP); Akira Shimodaira, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/580,706

(22) Filed: Sep. 24, 2019

(30) Foreign Application Priority Data

May 31, 2019 (JP) ..... 2019-102822

(51) Int. Cl.
*G03G 15/08* (2006.01)
*G03G 15/16* (2006.01)
*G03G 21/10* (2006.01)

(52) U.S. Cl.
CPC ..... *G03G 15/0812* (2013.01); *G03G 15/167* (2013.01); *G03G 15/168* (2013.01); *G03G 21/10* (2013.01); *G03G 2215/00409* (2013.01); *G03G 2215/1614* (2013.01); *G03G 2215/1652* (2013.01)

(58) Field of Classification Search
CPC ..... G03G 15/0812; G03G 15/165; G03G 15/167; G03G 15/168; G03G 2215/00409; G03G 2215/1614; G03G 2215/1647; G03G 2215/1652; G03G 21/0029; G03G 21/10
See application file for complete search history.

(56) References Cited

U.S. PATENT DOCUMENTS 8,131,196 B2 * 3/2012 Suzuki ..... G03G 15/1685 399/101
2002/0131796 A1 * 9/2002 Kida ..... G03G 15/167 399/316
2017/0176892 A1 * 6/2017 Miyakoshi ..... G03G 15/168
2018/0046115 A1 * 2/2018 Fujita ..... G03G 15/1615

FOREIGN PATENT DOCUMENTS

JP 7-302028 A 11/1995
JP 2002-311766 A 10/2002

* cited by examiner

*Primary Examiner* — Walter L Lindsay, Jr.
*Assistant Examiner* — Laura Roth
(74) *Attorney, Agent, or Firm* — Sughrue Mion, PLLC

(57) ABSTRACT

A cleaning device for a rotational body is provided. The cleaning device includes a scraping portion whose edge is pressed against a rotational body to which toner adheres. The scraping portion scrapes the toner off the rotational body. The cleaning device also includes a guide portion that guides a recording medium toward the rotational body, and a guide support portion that supports the guide portion. The guide support portion is disposed at a position separated from the scraping portion in a state in which the guide support portion is pressed by the guide portion that is guiding the recording medium.

13 Claims, 10 Drawing Sheets

CLEANING DEVICE HAVING A ROLLER SCRAPING MEMBER AND GUIDE PORTION

CROSS-REFERENCE TO RELATED APPLICATIONS

This application is based on and claims priority under 35 USC 119 from Japanese Patent Application No. 2019-102822 filed May 31, 2019.

BACKGROUND

(i) Technical Field

The present disclosure relates to a cleaning device.

(ii) Related Art

Japanese Unexamined Patent Application Publication No. 2002-311766 describes a cleaning device that cleans a moving body, which circulates, by removing image-forming particles that remain on the moving body. The cleaning device includes an undeformable cleaning member and an accumulation assisting member. The undeformable cleaning member is a plate-shaped member that is partially fixed and that has a free end that contacts the moving body. The shape of a contact portion of the undeformable cleaning member is maintained in an undeformed state regardless of whether the moving body moves or stops. The accumulation assisting member is attached to a back surface of the contact portion of the undeformable cleaning member, is disposed so as not to contact the moving body, and assists in forming a particle accumulation portion S where image-forming particles that are scraped off by the undeformable cleaning member accumulate.

SUMMARY

A structure that has a scraping portion that scrapes the toner off a rotational body, to which toner adheres, by pressing an edge thereof against the rotational body is known. A structure that has a guide portion that guides a recording medium to a rotational body is also known. The guide portion may bend, for example, when a recording medium is transported to the guide portion and presses the guide portion. If the bent guide portion presses the scraping portion, for example, the position of the scraping portion relative to the rotational body may become displaced.

Aspects of non-limiting embodiments of the present disclosure relate to suppressing displacement of a scraping portion that may occur when a recording medium is transported to a guide portion, compared with a case where the guide portion presses the scraping portion.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

A cleaning device includes a scraping portion whose edge is pressed against a rotational body to which toner adheres and that scrapes the toner off the rotational body, a guide portion that guides a recording medium toward the rotational body, and a guide support portion that supports the guide portion and that is disposed at a position separated from the scraping portion in a state in which the guide support portion is pressed by the guide portion that is guiding the recording medium.

BRIEF DESCRIPTION OF THE DRAWINGS

An exemplary embodiment of the present disclosure will be described in detail based on the following figures, wherein.

DETAILED DESCRIPTION

Hereafter, an exemplary embodiment of the present disclosure will be described with reference to the drawings.

Image Forming Apparatus 100

Figure 1:
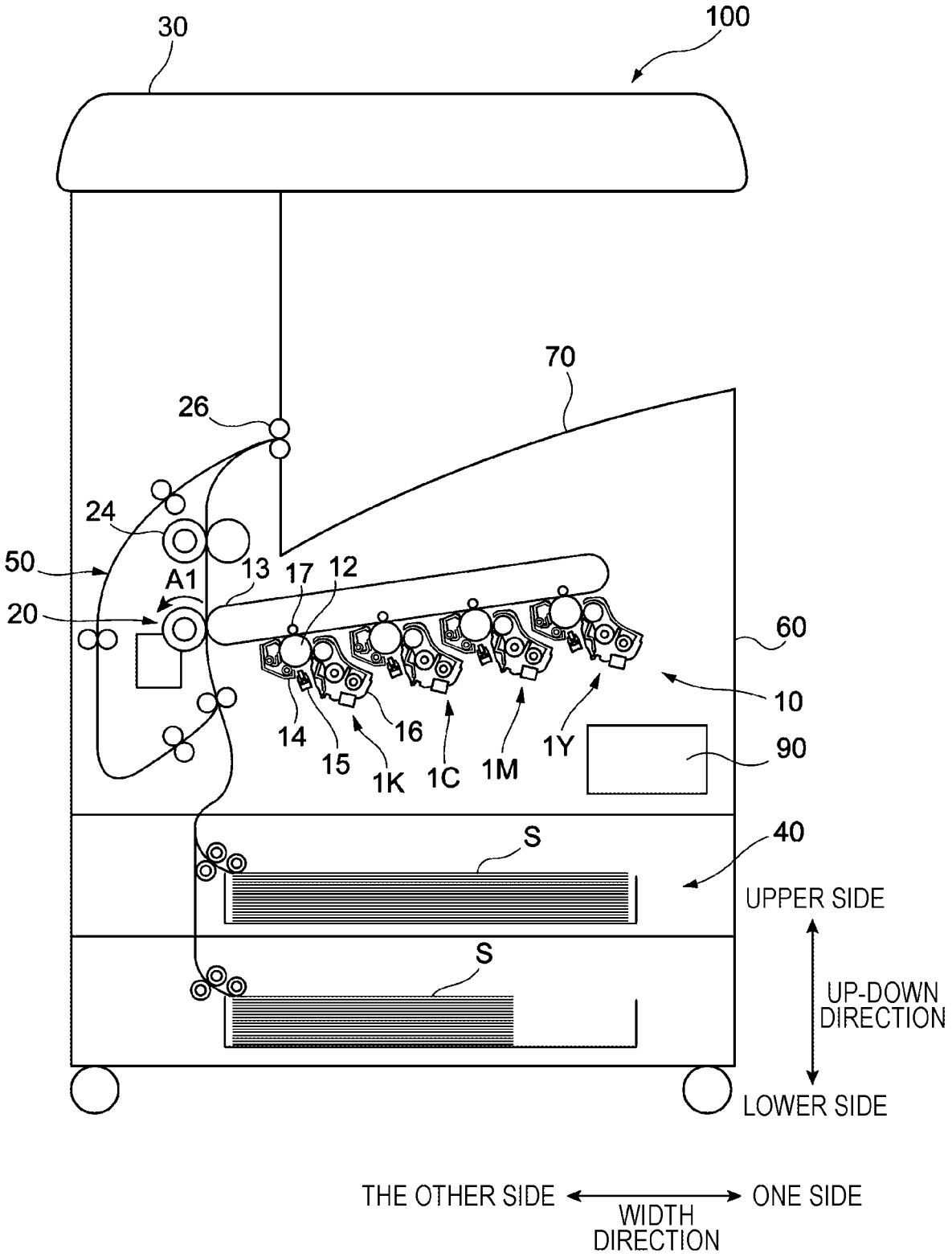
FIG. 1 is a schematic view of an image forming apparatus according to the exemplary embodiment.

FIG. 1 is a schematic view of an image forming apparatus 100 according to the present exemplary embodiment. The image forming apparatus 100 illustrated in FIG. 1 is a tandem color printer. The image forming apparatus 100 includes the following: an image forming section 10 that forms images corresponding to image data items for respective colors; an image scanner 30 that scans an image of a document; a sheet feeder 40 that supplies a sheet S to the image forming section 10; a transport section 50 that transports the sheet S when the image forming apparatus 100 performs duplex printing to form images on both sides of the sheet S; and a controller 90 that controls the operation of the entirety of the image forming apparatus 100.

The constituent elements of the image forming apparatus 100 are contained in a casing 60. A stacker 70 is disposed at an upper surface of the casing 60 below the image scanner 30. Sheets S on which images have been formed by the image forming section 10 are stacked on the stacker 70.

Image Forming Section 10

The image forming section 10 includes four image forming units 1Y, 1M, 1C, and 1K that are arranged side by side at regular intervals. Each of the image forming units 1Y, 1M, 1C, and 1K forms a toner image by using an electrophotographic method. The image forming units 1Y, 1M, 1C, and 1K have the same structure, except that toners contained in developing devices 16 (described below) differ from each other. The image forming units 1Y, 1M, 1C, and 1K respectively form yellow (Y), magenta (M), cyan (C), and black (K) toner images.

The image forming section 10 includes an intermediate transfer belt 13 to which the color toner images formed on photoconductor drums 12 of the image forming units 1 are transferred. The image forming section 10 includes first-transfer rollers 17 that successively transfer (first-transfer) the color toner images formed by the image forming units 1 to the intermediate transfer belt 13. The image forming section 10 further includes a second-transfer device 20 that simultaneously transfers (second-transfers) the color toner images that overlap on the intermediate transfer belt 13 to the sheet S, a fixing device 24 that fixes the second-transferred color toner images to the sheet S, and an output roller 26 that outputs the sheet S.

Image Forming Unit 1

Each of the image forming units 1 includes the photoconductor drum 12 that holds a toner image, a charging device 14 that charges the photoconductor drum 12, an exposure device 15 that exposes the surface of the charged photoconductor drum 12 to form an electrostatic latent image, and the developing device 16 that develops the electrostatic latent image on the photoconductor drum 12 to form a toner image. In the developing device 16, a two-component developer, which includes a magnetic carrier and a toner having a predetermined color, is used.

Image Forming Process

The image forming apparatus 100 performs an image forming process under the control by the controller 90. That is, image data is obtained from a PC (not shown) or the image scanner 30, an image processor (not shown) processes the image data to generate image data items for respective colors, and the image data items are sent to the exposure devices 15 of the image forming units 1. The exposure devices 15 perform exposure and the developing devices 16 perform development, thereby forming toner images on the photoconductor drums 12.

The first-transfer rollers 17 successively first-transfer the color toner images formed on the photoconductor drums 12 of the image forming units 1 to the intermediate transfer belt 13, thereby forming an overlapping toner image in which the color toner images overlap. The overlapping toner image is transported toward the second-transfer device 20 as the intermediate transfer belt 13 moves.

A sheet S is supplied from the sheet feeder 40 and is transported to the second-transfer device 20 with a timing corresponding to the timing with which the overlapping toner image on the intermediate transfer belt 13 is transported to the second-transfer device 20. The second-transfer device 20 second-transfers the overlapping toner image from the intermediate transfer belt 13 to the sheet S. The fixing device 24 fixes the overlapping toner image, which has been transferred to the sheet S, to the sheet S. The output roller 26 outputs the sheet S to the stacker 70. When the image forming apparatus 100 performs duplex printing, the transport section 50 transports the sheet S, on a front surface (first surface) of which a fixed image has been formed through the process described above, again to the second-transfer device 20, and a fixed image is formed on a back surface (second surface) of the sheet S.

The temperature of the second-transfer device 20 easily increases because of the position thereof in the image forming apparatus 100. To be specific, the temperature of the second-transfer device 20 easily increases, because the fixing device 24 generates heat. In particular, the temperature of the second-transfer device 20 easily increases during duplex printing, because a sheet S whose temperature has been increased due to fixing of an image to the front surface (first surface) thereof is transported again to the second-transfer device 20 via the transport section 50. Moreover, as described below, the second-transfer device 20 causes a second-transfer roller 21 to form a nip with the intermediate transfer belt 13, and a cleaning device 22 cleans the second-transfer roller 21. With such a structure, the distance from a nip point to a region to be cleaned along the outer periphery of the second-transfer roller 21 is short, and the temperature of the second-transfer device 20 easily increases, compared with, for example, a case where the second-transfer roller 21 is composed of a belt (not shown).

In the following description, the up-down direction of the image forming apparatus 100 illustrated in FIG. 1 (vertical direction) may be simply referred to as the "up-down direction". The upper side in the up-down direction in FIG. 1 may be simply referred to as the "upper side", and the lower side in the up-down direction may be simply referred to as the "lower side". The left-right direction of the image forming apparatus 100 illustrated in FIG. 1 may be simply referred to as the "width direction". The right side along the plane of FIG. 1 may be simply referred to as the "one side", and the left side along the plane of FIG. 1 may be simply referred to as "the other side". The depth direction of the image forming apparatus 100 with respect to the plane of FIG. 1 may be simply referred to as the "depth direction". The proximal side of the plane of FIG. 1 may be simply referred to as the "proximal side", and the distal side of the plane of FIG. 1 may be simply referred to as the "distal side" (see FIG. 2).

Second-Transfer Device 20

Figure 2:
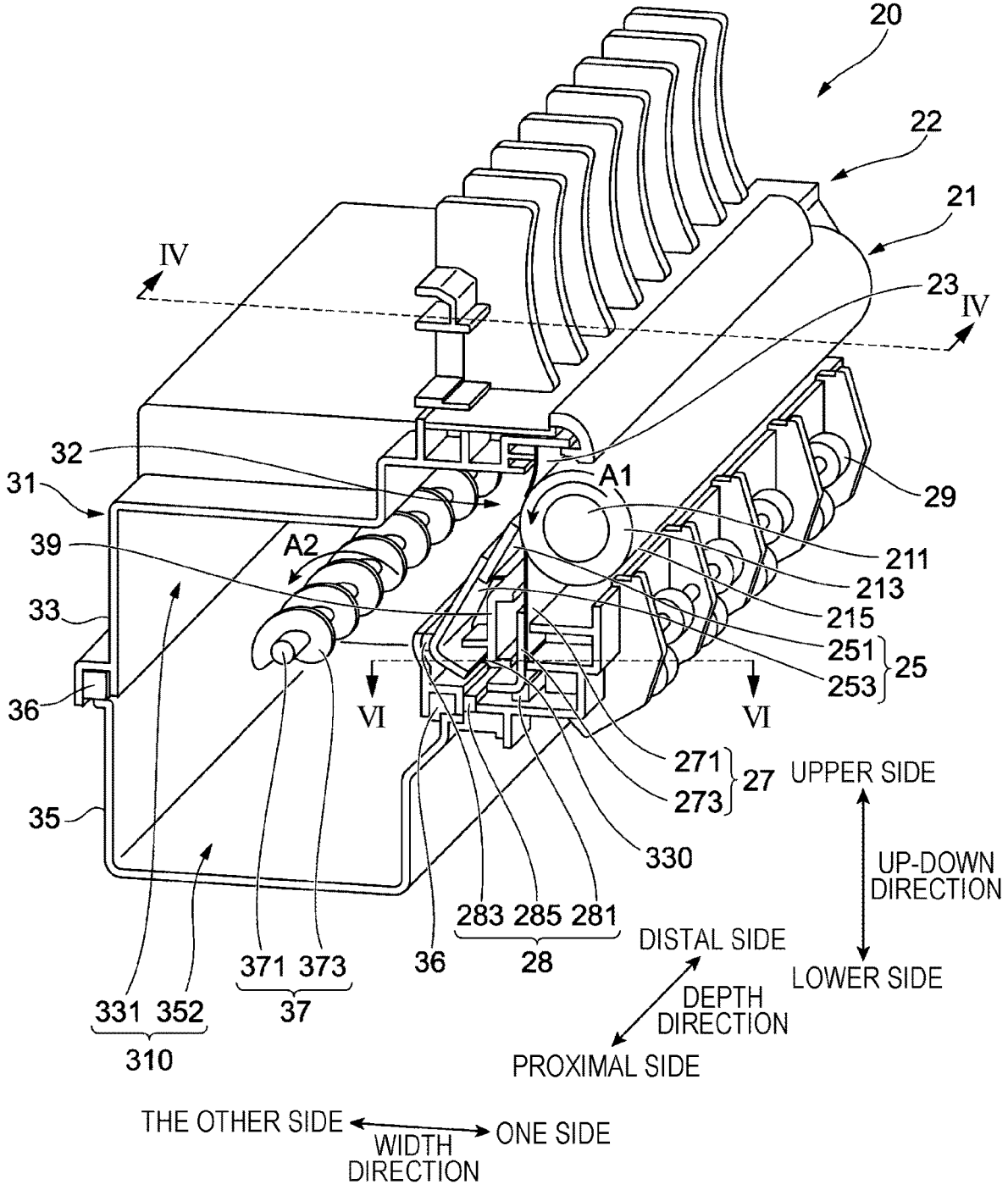
FIG. 2 is a perspective view of a second-transfer device according to the exemplary embodiment.

FIG. 2 is a perspective view of the second-transfer device 20 according to the present exemplary embodiment.

Figure 3:
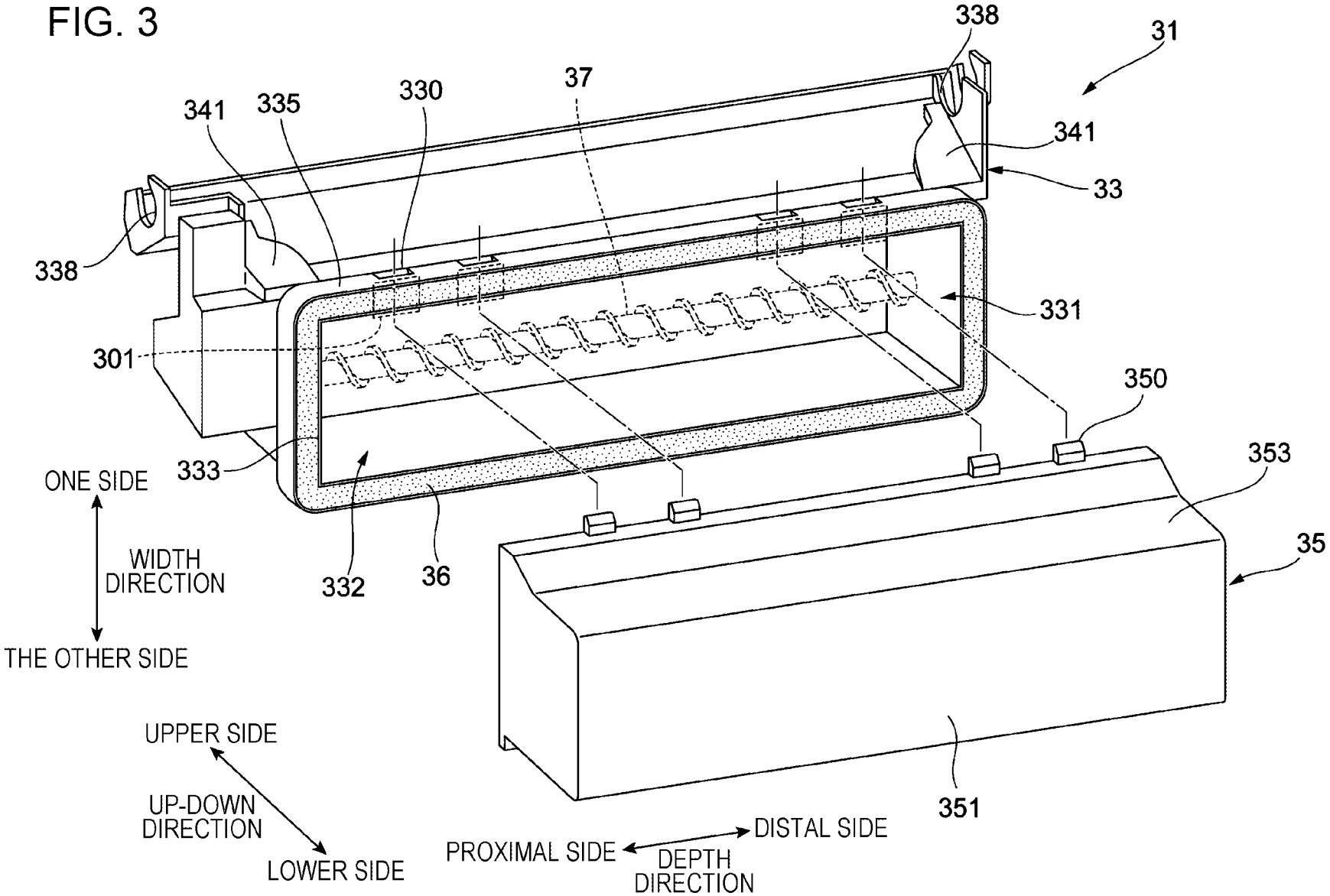
FIG. 3 is a perspective view of a housing body and a housing cover.

FIG. 3 is a perspective view of a housing body 33 and a housing cover 35. In FIG. 3, a part of the structure of a housing 31 is simplified for clarity.

Next, referring to FIGS. 1 to 3, the second-transfer device 20 according to the present exemplary embodiment will be described.

As illustrated in FIG. 2, the second-transfer device 20 includes the second-transfer roller 21 and the cleaning device 22. The second-transfer roller 21 rotates while being in contact with the outer peripheral surface of the intermediate transfer belt 13 (see FIG. 1) with a predetermined pressure. The cleaning device 22 cleans the outer peripheral surface of the second-transfer roller 21 by removing unwanted substances, such as toner and paper powder, that remain on and adheres to the outer peripheral surface.

The second-transfer roller 21 is a cylindrical member that includes at least an elastic layer and is rotatable in a predetermined direction (see arrow A1). The second-transfer roller 21 illustrated in FIG. 2 has a structure such that an elastic layer 213 and a surface layer 215 are formed in this order on the outer peripheral surface of an electroconductive roller base 211, which is made of a metal or the like. The elastic layer 213 is made of, for example, a material that includes an elastic material such as foamed polyurethane and an electroconductive material such as carbon black. The elastic layer 213, which is elastically deformable, reduces friction with an abutting member such as a scraper 27. The surface layer 215 is made of, for example, a synthetic resin such as a polyimide resin. The second-transfer roller 21 illustrated in FIG. 2 is capable of contacting and separating from the outer peripheral surface of the intermediate transfer belt 13 (see FIG. 1).

The cleaning device 22 includes a roller seal 23, a blade 25, and the scraper 27, which are located along the outer periphery of the second-transfer roller 21. The cleaning device 22 includes a housing seal 28, auxiliary rollers 29, the housing 31, an auger 37, and a block 39. Hereafter, the constituent elements of the cleaning device 22 will be described. Then, the structure of the block 39 will be described below in detail.

The roller seal 23 is an elongated film-shaped member (plate-shaped member) whose longitudinal direction coincides with the direction in which the rotation axis of the second-transfer roller 21 extends. One end (base) of the roller seal 23 in a direction (seal width direction) perpendicular to the longitudinal direction is supported by the housing 31. The other end (edge) of the roller seal 23 in the seal width direction is in contact with the outer peripheral surface of the second-transfer roller 21. The entirety of the roller seal 23 is disposed in a curved state. The roller seal 23 prevents leakage of unwanted substances, such as toner, collected by the blade 25 and the like, to the outside of the housing 31. That is, the roller seal 23 functions as a cover member that covers a cleaning opening 32 (described below) of the housing 31.

The blade 25 includes a blade body 251 and a blade holder 253 that holds the blade body 251. The blade body 251 is an elongated plate-shaped member whose longitudinal direction coincides with the direction in which the rotation axis of the second-transfer roller 21 extends. One end (base) of the blade body 251 in a direction (blade width direction) perpendicular to the longitudinal direction is supported by the blade holder 253. The other end (edge) of the blade body 251 in the blade width direction is in contact with the outer peripheral surface of the second-transfer roller 21. The blade body 251 is in contact with the second-transfer roller 21 at a position on the downstream side of the roller seal 23 in the rotation direction of the second-transfer roller 21 (see arrow A1). The blade body 251 is made of an elastically deformable material such as a rubber or a synthetic resin. The blade holder 253 is made by bending a metal plate, having a substantially rectangular shape in plan view, to have an L-shaped cross section. The blade holder 253 is supported by the housing 31 (as described below in detail).

The blade 25 presses the edge of the blade body 251 against the outer peripheral surface of the second-transfer roller 21 and scrapes off toner that adheres to the second-transfer roller 21. The term "serape off" refers to removing substances that adhere to a surface of an object (such as the second-transfer roller 21) by causing a constituent member (such as the blade body 251) to contact the object. That is, the blade 25 can be regarded as a cleaning member that cleans the second-transfer roller 21. The blade 25 illustrated in FIG. 2 suppresses leakage of unwanted substances, such as collected toner, to the outside of the housing 31. That is, the blade 25 functions as a member that covers the cleaning opening 32 (described below) of the housing 31.

The scraper 27 includes a scraper body 271 and a scraper holder 273 that holds the scraper body 271. The scraper body 271 is an elongated plate-shaped member whose longitudinal direction coincides with the direction in which the rotation axis of the second-transfer roller 21 extends. One end (base) of the scraper body 271 in a direction (scraper width direction) perpendicular to the longitudinal direction is supported by the scraper holder 273. The other end (edge) of the scraper body 271 in the scraper width direction is in contact with the outer peripheral surface of the second-transfer roller 21. The scraper body 271 is in contact with the second-transfer roller 21 at a position on the downstream side of the blade body 251 in the rotation direction of the second-transfer roller 21 (see arrow A1). The scraper body 271 is made of a metal or the like and is structured to have higher rigidity than the blade body 251. The scraper body 271 is made from a member (thin plate) whose thickness (plate thickness) is smaller than that of the blade body 251.

The scraper holder 273 is made by bending a metal plate, having a substantially rectangular shape in plan view, to have an L-shaped cross section. The scraper holder 273 is supported by the housing 31 via the block 39 (as described below in detail). The scraper holder 273 and the blade holder 253 are disposed in such a way that the longitudinal directions thereof coincide with the depth direction and the bent portions thereof are separated from the other. The scraper holder 273 and the blade holder 253 are fixed to the same block 39 (as described below in detail).

The scraper 27 presses the edge of the scraper body 271 against the outer peripheral surface of the second-transfer roller 21 and scrapes off toner that adheres to the second-transfer roller 21. To be more specific, the scraper 27 removes unwanted substances that are not removed by the blade 25. Toner or the like that adheres to the second-transfer roller 21 may cause so-called "filming", which is a phenomenon in which the toner or the like forms a film that firmly adheres to the surface of the second-transfer roller 21. The scraper 27 scrapes the surface of the second-transfer roller 21 with the edge of the scraper body 271 to remove the film of toner formed by filming. The scraper 27 is pressed against the second-transfer roller 21 with a force (for example, a vertical load) that is larger than that of the blade 25. Because the blade 25 removes unwanted substances in advance, it is possible to reduce a force that presses the scraper 27, which is located at a position on the downstream side of the blade 25 in the rotation direction of the second-transfer roller 21 (see arrow A1), against the second-transfer roller 21.

The housing seal 28 is an elongated film-shaped member (plate-shaped member) whose longitudinal direction coincides with the direction in which the rotation axis of the second-transfer roller 21 extends. The housing seal 28 is made of an elastically deformable material such as polyurethane. The housing seal 28 restricts passing of toner therethrough while allowing passing of a gas (air) therethrough. To be more specific, the housing seal 28 is a gas-permeable member that has a large number of small pores, each of which is smaller than the particle size of toner. The housing seal 28 can be regarded as a mesh member. The housing seal 28 illustrated in FIG. 2 includes a scraper seal 281, a blade seal 283, and a middle seal 285. The scraper seal 281 is disposed between the scraper holder 273 and the housing body 33 (described below). To be more specific, the scraper seal 281 is disposed between the scraper holder 273 and the housing body 33 (described below), and the scraper seal 281 is sandwiched between the scraper holder 273 and the housing body 33 (described below). The scraper seal 281 forms a space between the scraper holder 273 and the housing body 33 (described below). The blade seal 283 is disposed between the blade holder 253 and the housing body 33. The middle seal 285 is disposed in a gap (recess) in the housing body 33.

The auxiliary rollers 29 include plural roller pairs that are arranged in the depth direction. The auxiliary rollers 29 are rollers that guide a sheet S, which is supplied from the sheet feeder 40 (see FIG. 1), to a nip between the second-transfer roller 21 and the intermediate transfer belt 13 as the roller pairs rotate. The auxiliary rollers 29 function as a sheet-passing guide that guides the sheet S along a path toward the second-transfer roller 21.

Next, referring to FIGS. 2 and 3, the housing 31 will be described. The housing 31 is a box-shaped structure whose longitudinal direction coincides with the direction in which the rotation axis of the second-transfer roller 21 extends and that opens toward the second-transfer roller 21. To be more specific, the housing 31 has the cleaning opening 32 in a portion thereof that is on the upper side in the up-down direction and on one side in the width direction. The cleaning opening 32 is a rectangular opening that faces the outer peripheral surface of the second-transfer roller 21.

The housing 31 includes the housing body 33, the housing cover 35 that is fixed to the housing body 33, and a cover seal 36 that is interposed between the housing body 33 and the housing cover 35. The housing body 33 and the housing cover 35 constitute a waste toner container (waste toner box) 310. Toner (waste toner) collected by the blade 25 is accumulated in an inner space of the waste toner container 310, which is a space interposed between the housing body 33 and the housing cover 35.

As illustrated in FIG. 3, the housing body 33 contains the auger 37 and forms an upper space 331 in an upper part of the waste toner container 310. The housing body 33 has an opening 332 that is in a lower part thereof in the up-down direction and that has a substantially rectangular shape in a front view. The housing body 33 has a seal groove 333 that surrounds the opening 332. That is, the seal groove 333 is a ring-shaped groove that is formed along the opening 332. The housing body 33 has plural (four) through-holes 330 that are formed in a body side surface 335 and that allow the inside and the outside of the waste toner container 310 to communicate with each other. Details of the through-holes 330 will be described below.

As illustrated in FIG. 3, the housing cover 35 includes a cover body 351 that covers the opening 332 of the housing body 33. The housing cover 35 is a box-shaped member whose side facing the housing body 33 is open. The housing cover 35 forms a lower space 352 (see FIG. 2) in a lower part of the waste toner container 310. The housing cover 35 includes a cover side surface 353, which is located on one side in the width direction in a state in which the housing cover 35 is fixed to the housing body 33, and plural (four) cover tabs 350, which protrude toward the one side in the width direction from the cover side surface 353. The cover tabs 350 are inserted into the through-holes 330 of the housing body 33 and determine the position of the housing cover 35 relative to the housing body 33. The cover tabs 350 illustrated in FIG. 3 are each a plate-shaped member that is disposed in a direction such that a plate surface thereof intersects the up-down direction. The cover tabs 350 are arranged in the depth direction. Details of the structure of each of the cover tabs 350 will be described below.

As illustrated in FIG. 3, the cover seal 36 is a ring-shaped member that is made of an elastically deformable material such as polyurethane. The cover seal 36 illustrated in FIG. 3 is fitted into the seal groove 333, which has a ring-like shape. The cover seal 36 restricts passing of toner while allowing passing of a gas (air) therethrough. To be more specific, the cover seal 36 is a gas-permeable member that has a large number of small pores smaller than the particle size of toner. The cover seal 36 can be regarded as a mesh member. The cover seal 36 suppresses a flow of waste toner, which is contained in the waste toner container 310, to the outside.

As illustrated in FIG. 2, the auger 37 includes a rotation shaft 371 and a screw blade 373 disposed on the outer periphery of the rotation shaft 371. As the rotation shaft 371 of the auger 37 rotates (see arrow A2 in FIG. 2) by receiving a driving force from a driving source (not shown), the screw blade 373 transports toner contained in the waste toner container 310 in the depth direction. Thus, the auger 37 levels the waste toner contained in the waste toner container 310. That is, the auger 37 suppresses piling up of the waste toner in a partial region of the waste toner container 310. As the auger 37 receives a driving force from the driving source and rotates, the auger 37 accelerates the flow of a gas in the waste toner container 310. The flow of the gas in the waste toner container 310 will be described below.

Through-Hole 330

Figure 4:
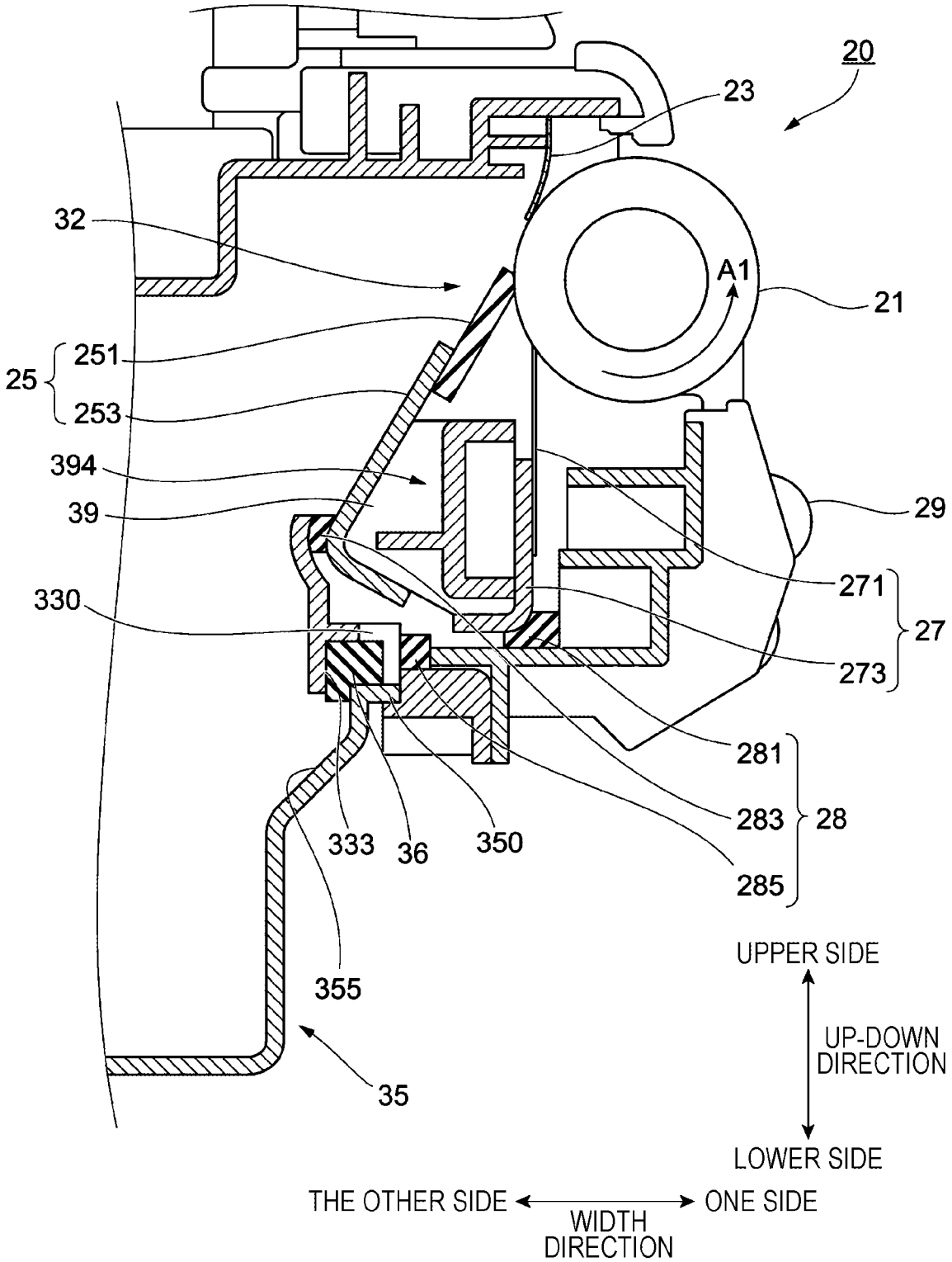
FIG. 4 is an enlarged sectional view of the second-transfer device, taken along line IV-IV of FIG. 2.

FIG. 4 is an enlarged sectional view of the second-transfer device 20, taken along line IV-IV in FIG. 2.

Figure 5:
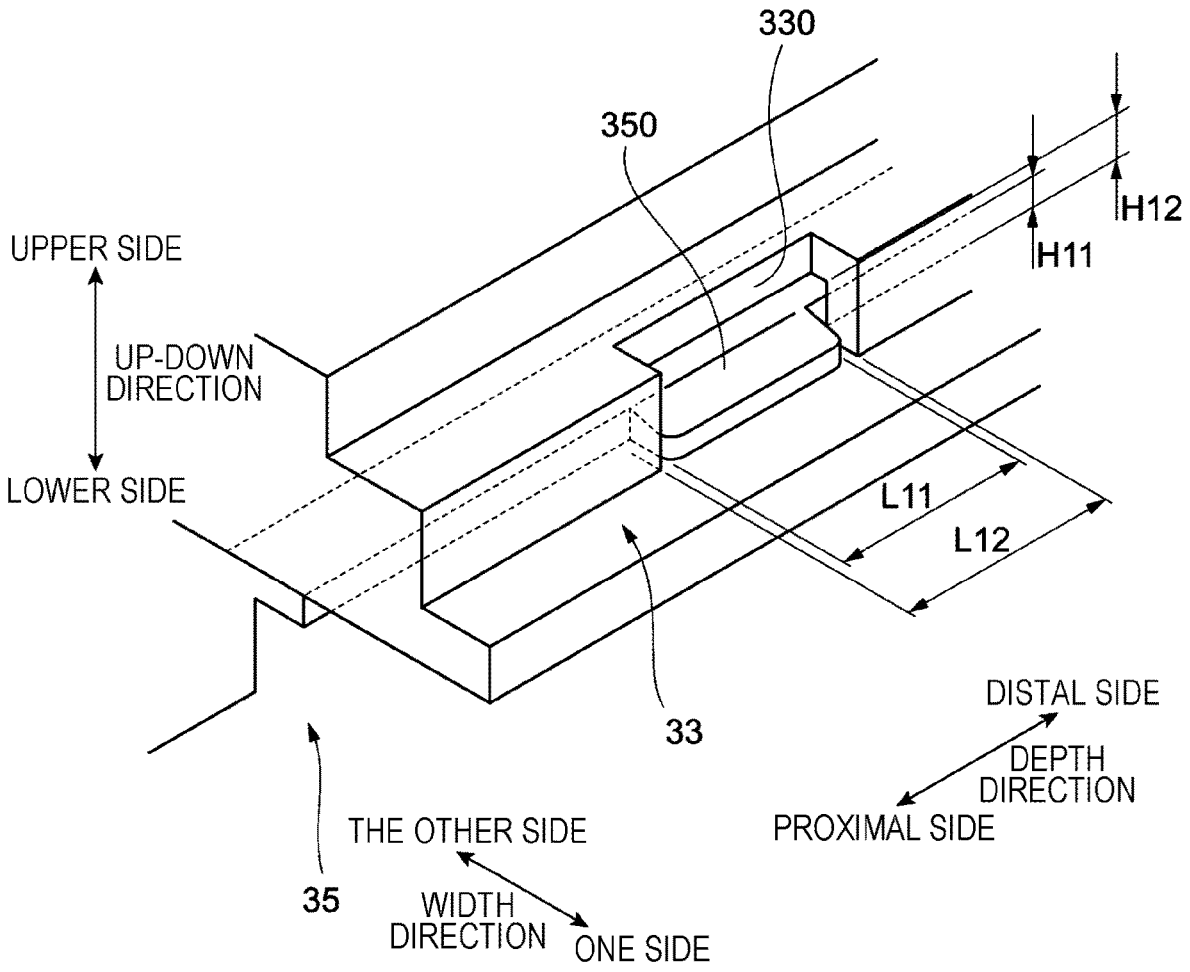
FIG. 5 illustrates the relationship between a through-hole and a cover tab.

FIG. 5 illustrates the relationship between one of the through-holes 330 and a corresponding one of the cover tabs 350.

Next, referring to FIGS. 3 to 5, how the through-holes 330 contribute to cooling of the scraper 27 will be described.

As described above, the scraper 27 is disposed in such a way that the edge of the scraper body 271 is in contact with the outer peripheral surface of the second-transfer roller 21. In this state, when the second-transfer device 20 operates and the second-transfer roller 21 rotates, the edge of the scraper body 271 rubs against the outer peripheral surface of the second-transfer roller 21 and generates frictional heat. The frictional heat increases the temperature of the scraper body 271 to, for example, 45° C. or higher. If the temperature of the scraper body 271 exceeds the melting temperature of toner, the toner melts and may firmly adhere to the scraper body 271. In the exemplary embodiment, the through-holes 330 are formed to suppress firm adhesion of toner due to increase in temperature of the scraper body 271.

As illustrated in FIG. 3, the through-holes 330, each of which is an opening having a substantially rectangular shape in a front view, are arranged in the depth direction. As illustrated in FIG. 4, each of the through-holes 330 is formed at a position where at least a part of the through-hole 330 faces the scraper 27. To be more specific, the through-hole 330 opens toward the scraper holder 273 of the scraper 27. The through-holes 330 allow a flow of a gas from the inside of the waste toner container 310 toward the scraper holder 273 of the scraper 27. As described below in details, although the internal pressure of the waste toner container 310 increases as the second-transfer roller 21 rotates, increase of the internal pressure of the waste toner container 310 is suppressed because the gas is released from the through-holes 330. Moreover, the scraper 27 is cooled due to the flow of the gas from the through-holes 330. To be more specific, it is possible to reduce the temperature of the scraper 27 by forming the through-holes 330 in the waste toner container 310, compared with a case where the through-holes 330 are not formed and the waste toner container 310 is tightly closed.

As illustrated in FIG. 3, the through-holes 330 extend through the body side surface 335 in the thickness direction and allow the body side surface 335 side and the inside of the seal groove 333 to communicate with each other. In other words, the through-holes 330 connect the inside and the outside of the body side surface 335. The cover seal 36 is disposed in the seal groove 333. A part of the cover seal 36 is exposed toward the inside of the waste toner container 310. With such a disposition, a gas that flows from the inside of the waste toner container 310 toward the through-holes 330 via the seal groove 333 passes through the cover seal 36. To be more specific, the gas from the inside of the waste toner container 310 passes through portions 301 of the cover seal 36 that face the through-holes 330. Thus, a flow of waste toner to the outside from the through-holes 330 is suppressed.

As illustrated in FIG. 5, each of the cover tabs 350 is inserted into a corresponding one of the through-holes 330 in order to fix the housing cover 35 to the housing body 33. The through-hole 330 illustrated in FIG. 5 has dimensions larger than those of the cover tab 350. Thus, in a state in which the cover tab 350 is inserted, the gas flows out from a gap formed between the cover tab 350 and the through-hole 330. To be specific, the length L12 of the through-hole 330 in the depth direction is larger than the length L11 of the cover tab 350 in the depth direction. Thus, in the state in which the cover tab 350 is inserted into the through-hole 330, a gap in the depth direction is formed. The length H12 of the through-hole 330 in the up-down direction is larger than the length H11 of the cover tab 350 in the up-down direction. Thus, in the state in which the cover tab 350 is inserted into the through-hole 330, a gap in the up-down direction is formed. Because the cover tab 350 have such dimensions, the gas flows out through a gap formed around the cover tab 350 in a state in which the cover tab 350 is inserted.

Supporting Structure for Auxiliary Rollers 29

Figure 6:
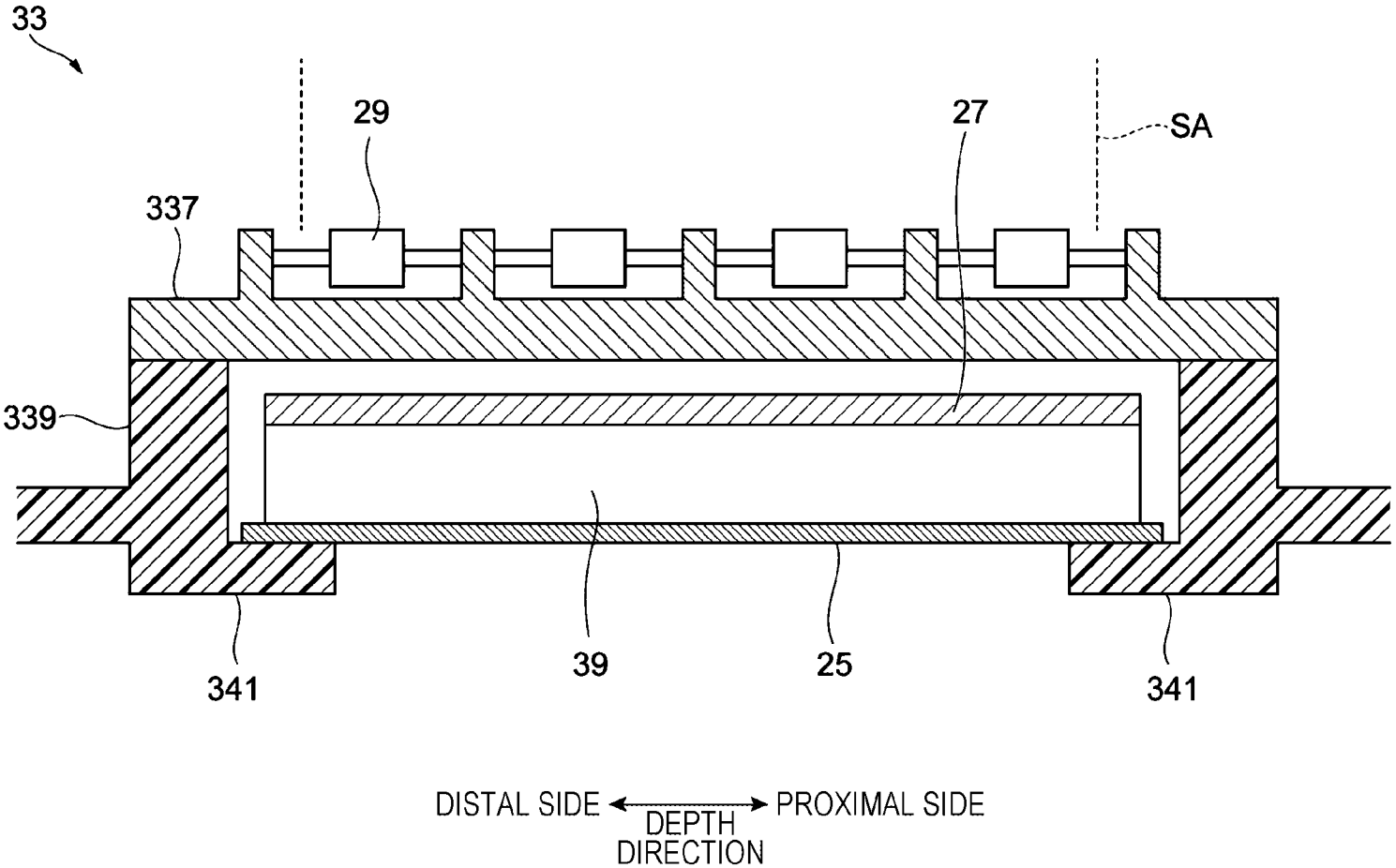
FIG. 6 illustrates a supporting structure for auxiliary rollers.

FIG. 6 illustrates a supporting structure for the auxiliary rollers 29. FIG. 6 is a schematic sectional view taken along line VI-VI in FIG. 2, which is simplified by, for example, omitting illustration of fixing members such as bolts.

Next, referring to FIG. 6, the supporting structure for the auxiliary rollers 29 according to the present exemplary embodiment will be described.

As illustrated in FIG. 6, the auxiliary rollers 29 are supported by the housing body 33. The housing body 33 includes an auxiliary-roller supporting portion 337, a housing base portion 339, and protruding portions 341. The auxiliary-roller supporting portion 337 rotatably supports each of the auxiliary rollers 29. The auxiliary-roller supporting portion 337 is a substantially rectangular-parallelepiped-shaped member and is disposed so that the longitudinal direction thereof coincides with the direction in which the rotation axis of the auxiliary rollers 29 extends. The length of the auxiliary-roller supporting portion 337 in the depth direction is smaller than that of a pass region SA for a sheet S. The housing base portion 339 is a member to which the auxiliary-roller supporting portion 337 is attached. The protruding portions 341 are members each of which is formed as a part of the housing base portion 339 and to which the block 39 and the like are attached (as described below in detail).

As a sheet S is transported from the downstream side in the transport direction, the sheet S collides with the auxiliary rollers 29. That is, the auxiliary rollers 29 receive an external impact when the sheet S passes. When the auxiliary rollers 29 receive the external impact, not only the auxiliary rollers 29 but also the auxiliary-roller supporting portion 337, which supports the auxiliary rollers 29, may receive an impact and may bend. If the auxiliary-roller supporting portion 337 bends, the auxiliary-roller supporting portion 337 may press the scraper 27, and the pressed scraper 27 may deform. If the scraper 27 deforms, a contact state in which the scraper 27 is in contact with the second-transfer roller 21 may change. To be specific, for example, the scraper 27 may become pressed against the second-transfer roller 21 to a smaller depth, and the scraping depth of the scraper 27 may change.

When the auxiliary rollers 29 receive an external impact, bending may be transmitted to the housing base portion 339 and the like, and as a result, for example, a contact state in which the blade 25 is in contact with the second-transfer roller 21 may change. To be specific, the scraping depth of the blade 25 may change.

Therefore, as illustrated in FIG. 6, the auxiliary-roller supporting portion 337 is disposed at a position separated from the scraper 27. That is, the auxiliary rollers 29 and the auxiliary-roller supporting portion 337, each of which may deform by receiving an external impact from the sheet S, are disposed in a floating manner relative to the scraper 27. Thus, even if the auxiliary-roller supporting portion 337 bends, deviation of the positional relationship between the edge of the scraper 27 and the second-transfer roller 21 and deviation of the positional relationship between the edge of the blade 25 and the second-transfer roller 21 are suppressed. That is, even if the auxiliary rollers 29 receive an external impact, the scraping depths of the scraper 27 and the blade 25 can be stabilized.

The scraper 27 and the blade 25 are both fixed to and integrated with the same block 39. Thus, the rigidity of the scraper 27 and the blade 25 is increased, and deviations of the positional relationships between the edges of the scraper 27 and the blade 25 and the second-transfer roller 21 are suppressed.

Housing Base Portion 339

Figure 7:
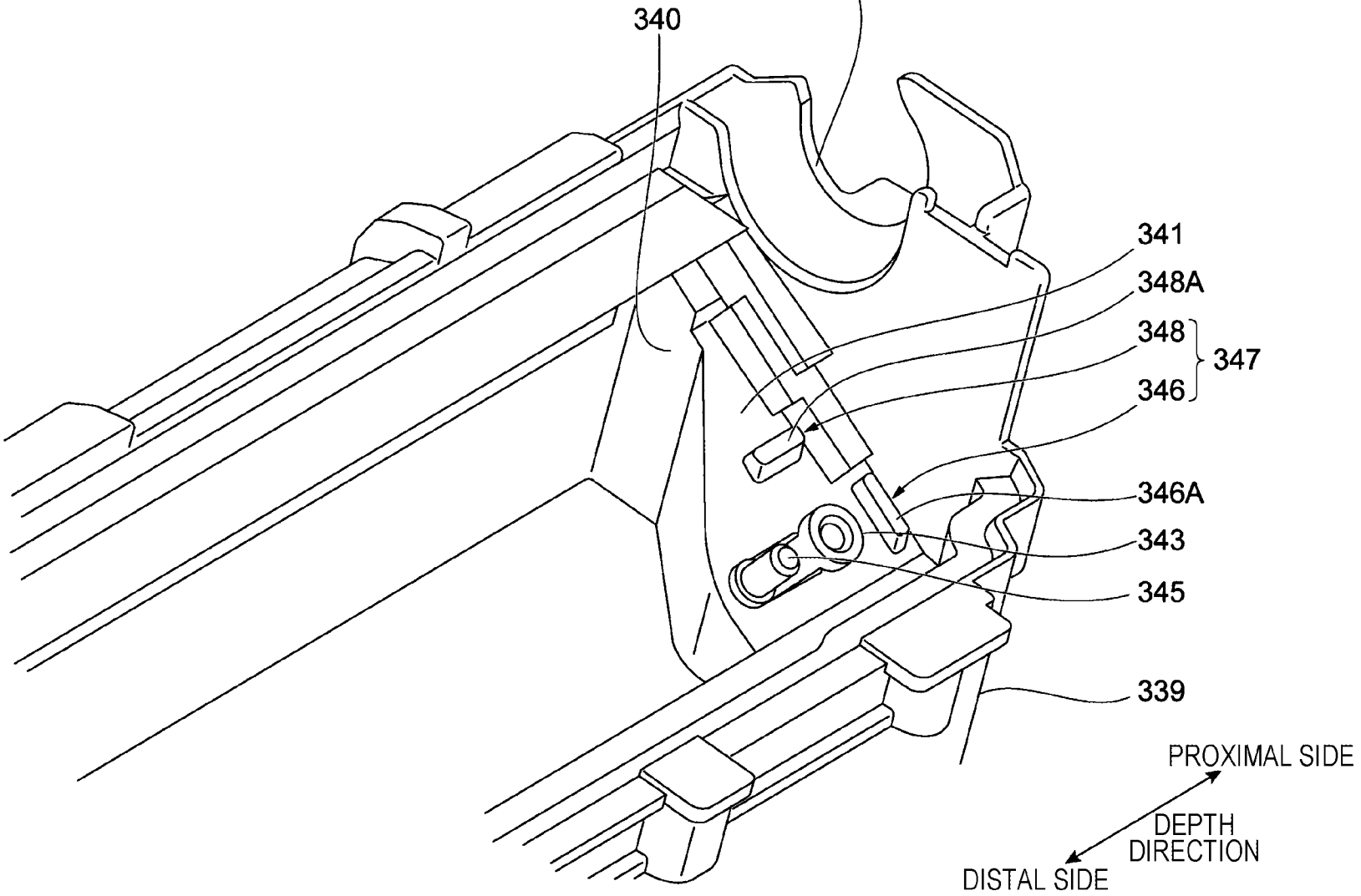
FIG. 7 illustrates a detailed configuration of a proximal part of a housing base portion in the depth direction.

FIG. 7 illustrates a detailed configuration of a proximal part of the housing base portion 339 in the depth direction.

Next, referring to FIG. 7, the detailed configuration of the proximal part of the housing base portion 339 in the depth direction will be described. In a distal part of the housing base portion 339 in the depth direction, members that are symmetrical with members described below are disposed.

As illustrated in FIG. 7, the housing base portion 339 is a housing that is made of a resin or the like. The housing base portion 339 includes a transfer-roller support portion 338, the protruding portion 341, a bolt receiving portion 343, a positioning pin 345, and a blade abutting portion 347. The transfer-roller support portion 338 rotatably supports the second-transfer roller 21. To be more specific, the transfer-roller support portion 338 is a cutout that has a substantially semicircular shape in a front view, and supports an outer periphery of a bearing (not shown) that supports the second-transfer roller 21.

The protruding portion 341 is a portion to which an end portion of the blade 25 in the depth direction (in FIG. 7, a proximal end portion in the depth direction) is fixed. To be more specific, the protruding portion 341 is a portion that protrudes from a side surface 340, which faces the end portion of the blade 25, of the housing base portion 339 toward the end portion of the blade 25. The bolt receiving portion 343, the positioning pin 345, and the blade abutting portion 347 are formed on the same surface of the protruding portion 341.

The positioning pin 345, which is a cylindrical pin, and the bolt receiving portion 343, which has an inner peripheral surface having an internal thread, each function as a positioning member when fixing the blade 25. To be specific, the positioning pin 345 and the bolt receiving portion 343 are respectively inserted into through-holes 25A and 25B (see FIG. 8 described below), which are formed in the blade holder 253.

The blade abutting portion 347 is a portion that is disposed on the protruding portion 341 and that is abutted against the blade 25. The blade abutting portion 347 includes a first abutting portion 346 and a second abutting portion 348, each of which protrudes from the protruding portion 341 toward the blade 25. The first abutting portion 346 and the second abutting portion 348 respectively have a first top 346A and a second top 348A that are flat. The blade 25 is fixed to the protruding portion 341 in a state in which the first top 346A and the second top 348A are abutted against the blade holder 253 of the blade 25. The first top 346A and the second top 348A illustrated in FIG. 7 are each substantially rectangular.

For example, it may be possible to press the entire surface of the protruding portion 341 against the blade holder 253.

By comparison, in the example illustrated in FIG. 7, the area of a portion that supports the blade holder 253 can be reduced, because the first abutting portion 346 and the second abutting portion 348 are formed on the protruding portion 341. Thus, even if the shape of a portion that supports the blade 25 has variation, twisting or the like of the blade 25 is suppressed.

In the example illustrated in FIG. 7, the orientations of the first abutting portion 346 and the second abutting portion 348 differ from each other. That is, the first top 346A of the first abutting portion 346 is disposed in an orientation such that the longitudinal direction thereof intersects the depth direction. On the other hand, the second top 348A of the second abutting portion 348 is disposed in an orientation such that the longitudinal direction thereof coincides with the depth direction. Because the first top 346A and the second top 348A are disposed in orientations that intersect each other, displacement of the blade holder 253 is suppressed while reducing the area of contact with the blade holder 253.

The transfer-roller support portion 338 and the blade abutting portion 347 illustrated in FIG. 7 are both formed in the housing base portion 339, which is one common member. With this structure, change in the relative positions of the transfer-roller support portion 338 and the blade abutting portion 347 is suppressed. To be more specific, displacements of the relative positions of the second-transfer roller 21, which is supported by the transfer-roller support portion 338, and the blade 25, which is supported by the blade abutting portion 347, are reduced.

Arrangement of Blade 25 and Protruding Portions 341

Figure 8:
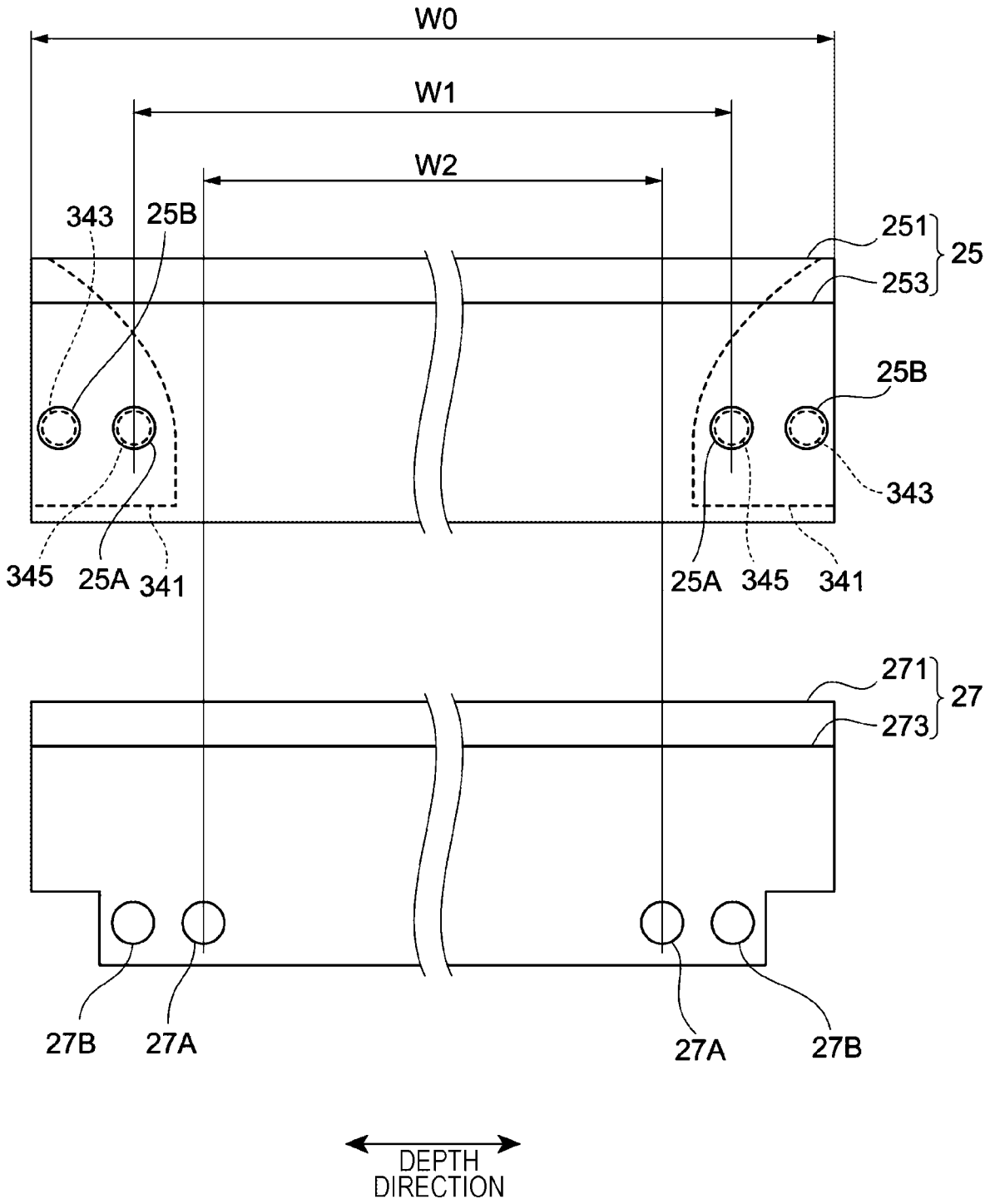
FIG. 8 illustrates an arrangement of blades and protruding portions.

FIG. 8 illustrates an arrangement of the blade 25 and the protruding portions 341.

Next, referring to FIG. 8, the arrangement of the blade 25 and the protruding portions 341 will be described.

As described above, two ends of the blade 25 are supported by the protruding portions 341. The positioning pins 345 and the bolt receiving portions 343, which are formed at end portions of the protruding portions 341, are inserted into the through-holes 25A and the through-holes 25B, which are formed in the blade holder 253 of the blade 25, and therefore the position of the blade 25 relative to the protruding portions 341 is determined. The block 39 is fixed to the blade 25, which is supported by the protruding portions 341, by using bolts (not shown) or the like.

Both ends of the scraper 27 are fixed to the block 39, which is fixed to the blade 25, by using bolts (not shown) or the like. Positioning pins (not shown), which are formed at end portions of the block 39, are inserted into through-holes 27A and through-holes 27B, which are formed in the scraper holder 273 of the scraper 27, and therefore the position of the scraper 27 relative to the block 39 is determined.

In the example illustrated in FIG. 8, the blade 25 and the scraper 27 have the same length W0 in the depth direction. On the other hand, the distance between the through-holes 25A disposed on inner sides of the blade 25, that is, the center-to-center distance W1 between the through-holes 25A is larger than the distance between the through-holes 27A disposed on inner sides of the scraper 27, that is, the center-to-center distance W2 of the through-holes 27A. That is, the through-holes 25A of the blade 25 are located closer than the through-holes 27A of the scraper 27 to the two ends of the blade 25, that is, are located on the outer sides of the through-holes 27A in the longitudinal direction. Thus, the area of regions of the blade 25 that are covered by the protruding portions 341 is reduced, and the exposed area of the blade 25 is increased. Accordingly, a gas that flows along the blade 25 can more easily cool the blade 25.

Block 39

Figure 9:
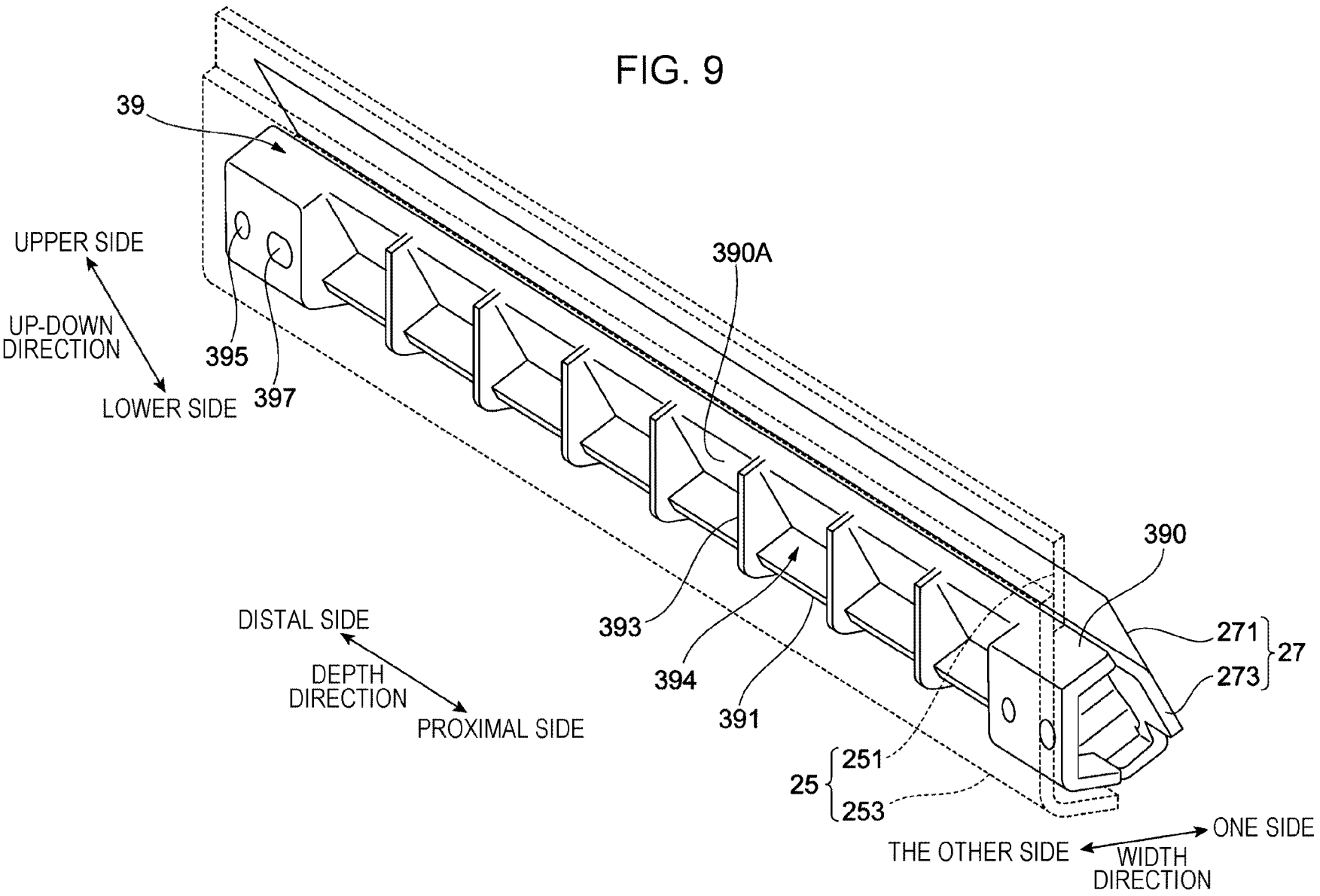
FIG. 9 is a schematic view of a block.

FIG. 9 is a schematic view of the block 39.

Next, referring to FIG. 9, the schematic structure of the block 39 will be described.

As illustrated in FIG. 9, the block 39 includes a block body 390, a receiving plate 391, partition plates 393, bolt holes 395, and through-holes 397. The block body 390 is a columnar member having a polygonal cross section. The block body 390 is disposed so that the longitudinal direction thereof coincides with the direction in which the rotation axis of the second-transfer roller 21 extends. In FIG. 9, the block body 390 is a member having a pentagonal cross section.

The block body 390 is disposed so as to be sandwiched between the scraper 27 and the blade 25. To be more specific, the scraper holder 273 and the blade holder 253 are fixed to the block body 390 by inserting bolts (not shown) or the like into the bolt holes 395 and the through-holes 397 of the block body 390. As described above, when attaching the blade 25 and the like to the housing base portion 339, the block 39 and the blade 25 are fixed to the housing base portion 339, and then the scraper 27 is fixed onto the block 39 that has been fixed (see FIG. 6 described above).

The receiving plate 391 is disposed on a blade facing surface 390A of the block body 390, which is a surface on a side to which the blade 25 is attached. The receiving plate 391 can be regarded as a portion that protrudes from the blade facing surface 390A toward the blade 25. A normal line of the plate surface of the receiving plate 391 extends in the up-down direction. A containing space 394 that contains toner is formed by the blade facing surface 390A and the receiving plate 391. The containing space 394 is partially covered also by the blade holder 253, as well as by the blade facing surface 390A and the receiving plate 391.

The partition plates 393 are formed on the blade facing surface 390A. In the example illustrated in FIG. 9, the partition plates 393 are arranged at predetermined intervals in the depth direction. A normal line of the plate surface of each of the partition plates 393 extends in the depth direction. The partition plates 393 divide the containing space 394, which is formed by the blade facing surface 390A and the receiving plate 391, into plural spaces.

The containing space 394 contains toner that is scraped off the second-transfer roller 21 by the scraper 27 and the blade 25. Because the containing space 394 is formed, re-adhesion of toner to the surface of the second-transfer roller 21 after the toner has been scraped off to the surface is suppressed. Moreover, the receiving plate 391 can suppress flow of a gas, which has flowed out from the through-holes 330 (described below), toward the containing space 394, and re-adhesion of toner to the surface of the second-transfer roller 21 after the toner has been scraped off to the surface is suppressed. Furthermore, the partition plates 393 can suppress movement of toner, which is contained in the containing space 394, in the depth direction, which may occur, for example, when the toner receives vibration or the like. Thus, the toner is piled up at one position, and adhesion of the piled-up toner to the surface of the second-transfer roller 21 is suppressed.

Flow of Gas

Figure 10:
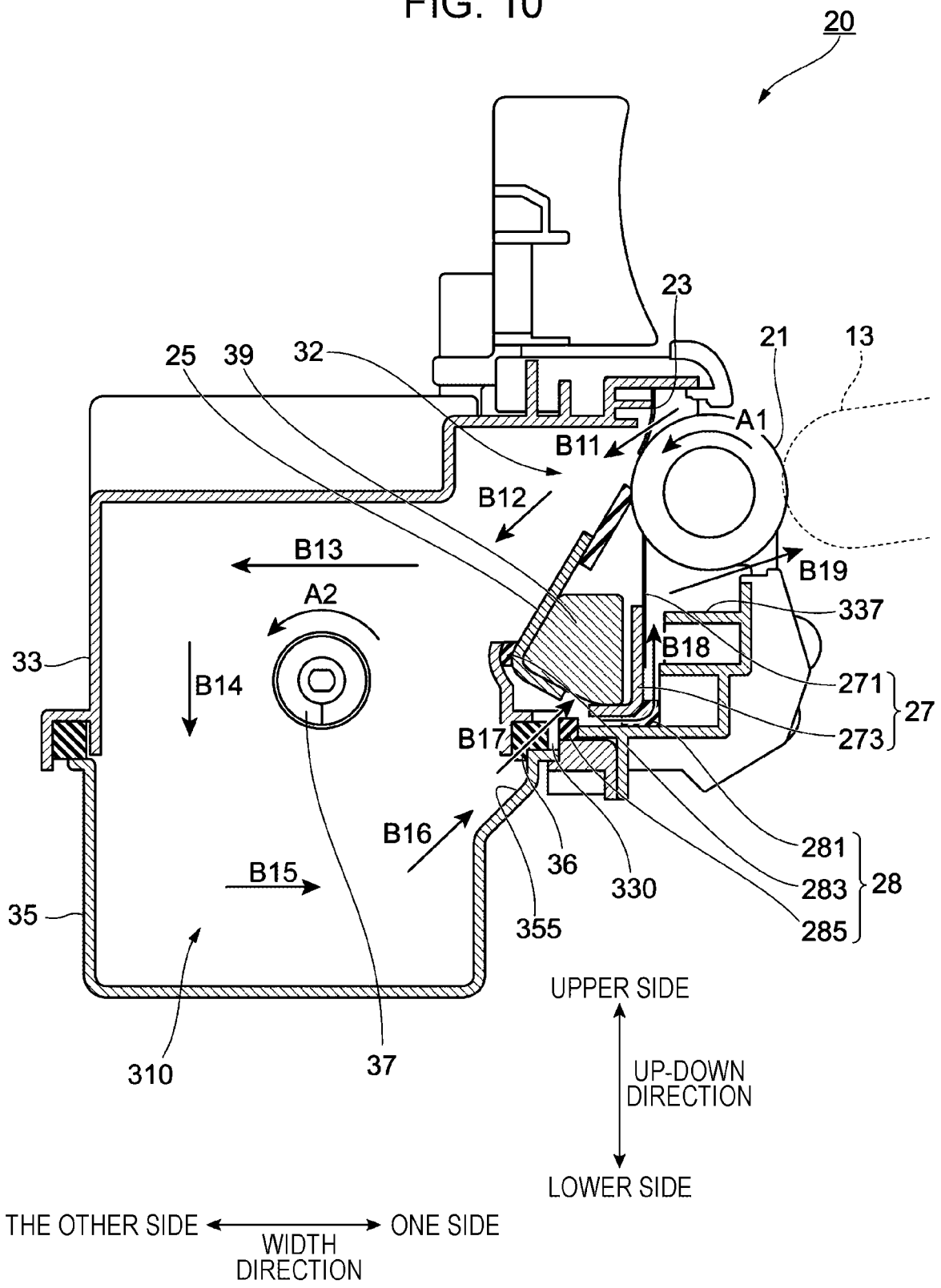
FIG. 10 illustrates flow of a gas in the second-transfer device.

FIG. 10 illustrates flow of a gas in the second-transfer device 20.

Next, referring to FIG. 10, the flow of the gas in the second-transfer device 20 will be described.

As illustrated in FIG. 10, in a state in which the second-transfer roller 21 is in contact (forms a nip) with the outer peripheral surface of the intermediate transfer belt 13, the cleaning opening 32 of the waste toner container 310 is covered by the second-transfer roller 21, the roller seal 23, and the blade 25. That is, the waste toner container 310 is a closed space.

When the second-transfer roller 21 rotates, the edge of the roller seal 23 in the seal width direction may swing, and a gap may be temporarily formed between the roller seal 23 and the second-transfer roller 21. When a gap is formed, the gas flows into the waste toner container 310 (see arrow B11 in FIG. 10), and the internal pressure of the waste toner container 310 increases. The gas that has flowed into the waste toner container 310 moves along the blade 25 (see arrow B12 in FIG. 10), and circulates in the waste toner container 310 (see arrows B13 to B16 in FIG. 10). Then, the gas in the waste toner container 310 flows out from the through-holes 330 (see arrow B17 in FIG. 10).

The block 39 changes the direction of flow of the gas flowed out from the through-holes 330. Then, the gas flows along the scraper 27, passes through a space between the scraper 27 and the auxiliary-roller supporting portion 337 (see arrow B18 in FIG. 10), flows along the outer periphery of the second-transfer roller 21, and flows to the outside of the second-transfer device 20 (see arrow B19 in FIG. 10). The scraper seal 281, which is sandwiched between the scraper holder 273 and the auxiliary-roller supporting portion 337, can be regarded as a member that forms a gas channel between the scraper holder 273 and the auxiliary-roller supporting portion 337.

The scraper 27, whose temperature has been increased by being rubbed against the second-transfer roller 21, is cooled by gas-flow between the scraper 27 and the auxiliary-roller supporting portion 337. Moreover, because the second-transfer roller 21 rotates (see arrow A1 in FIG. 10), gas-flow from the outer periphery of the second-transfer roller 21 to the outside of the second-transfer device 20 (see arrow B19 in FIG. 10) is accelerated. To be more specific, because the second-transfer roller 21 rotates, gas-flow between the scraper 27 and the auxiliary-roller supporting portion 337 (see arrow B18 in FIG. 10) is accelerated.

Moreover, due to the presence of the block 39, flowing of the gas into the space between the scraper 27 and the blade 25 is suppressed. Thus, floating of toner that has been scraped off the second-transfer roller 21, which may be caused by a gas flowed into the space between the scraper 27 and the blade 25, is suppressed.

Modifications

In the foregoing description of the exemplary embodiment, the cleaning device 22 that cleans the second-transfer roller 21 has been described. However, as long as the cleaning device 22 has a mechanism such that the edge thereof contacts the surface of a rotational body, an object to be cleaned by the cleaning device 22 is not limited to the second-transfer roller 21. For example, the structure described in the exemplary embodiment may be used in a cleaning device (not shown) that cleans the intermediate transfer belt 13, the photoconductor drum 12, or a transfer roller (not shown).

In the foregoing description of the exemplary embodiment, the cleaning device 22 includes both of the blade 25 and the scraper 27. However, the structure of the cleaning device 22 is not limited to this. For example, in a cleaning device that does not have the blade 25, the scraper 27 may be fixed by using the block 39. In a cleaning device that does not have the scraper 27, the blade 25 may be fixed by using the block 39. The block 39 may be omitted, and a cleaning device may have one of the blade 25 and the scraper 27.

In the foregoing description of the exemplary embodiment, the auxiliary rollers 29 are rotatable. However, the structure of the cleaning device is not limited to this. To be more specific, an unrotatable member, such as a plate-shaped member, a rail-shaped member, a block-shaped member, or the like may be used as a guide portion, as long as the unrotatable member has a structure that can guide a sheet S to a member disposed on the upstream side in the transport direction, such as the second-transfer roller 21, while being in contact with the sheet S that has been transported from the downstream side in the transport direction.

The cleaning device 22 in the foregoing description is an example of a cleaning device. The blade 25 and the scraper 27 are each an example of a scraping portion. The blade 25 is an example of a first scraping member and another scraping body. The scraper 27 is an example of a second scraping member and a scraping body. The second-transfer roller 21 is an example of a rotational body. The auxiliary rollers 29 are examples of a guide portion and a guide rotational body. The auxiliary-roller supporting portion 337 is an example of a guide support portion and a facing portion. The block 39 is an example of a fixing member and a support body. The receiving plate 391 is an example of a suppressing portion and a receiving portion. The waste toner container 310 is an example of a container. The partition plate 393 is an example of a partition portion. The housing base portion 339 is an example of a housing. The scraper seal 281 is an example of a sandwiched portion. The guide portion may have a rib-like shape or a planer shape, and the guide portion and the guide support portion may be integrally formed as a facing portion that faces the scraping portion.

The exemplary embodiment and the modifications described above may be used in combination.

The present disclosure is not limited to the exemplary embodiment described above and may be carried out in any forms within the spirit and scope of the present disclosure.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A cleaning device comprising:

a scraping portion pressed against a roller to which toner adheres and that scrapes the toner off the roller;

a guide portion that guides a recording medium toward the roller; and a guide support portion that supports the guide portion and that is disposed at a position separated from the scraping portion in a state in which the guide support portion is pressed by the guide portion that is guiding the recording medium, wherein the scraping portion includes a first scraping member whose edge is pressed against the roller and that scrapes the toner off the roller, a second scraping member that is disposed on a downstream side of the first scraping member in a rotation direction of the roller, whose edge is pressed against the roller, and that scrapes the toner off the roller, and a fixing member that is fixed to the first scraping member and the second scraping member.

2. The cleaning device according to claim 1, wherein the fixing member includes a suppressing portion that suppresses a flow of a gas toward a space between the first scraping member and the second scraping member.

3. The cleaning device according to claim 2, comprising:

a container that contains the toner that has been scraped off the roller by the scraping portion, wherein the guide support portion is disposed so as to face the second scraping member, and a gap in which a gas from an inside of the container flows is formed between the guide support portion and the second scraping member.

4. The cleaning device according to claim 3, wherein the roller is disposed at a position where the roller receives the gas that has passed through the gap from the inside of the container, and the roller rotates in a direction in which the gas flows toward the roller from the gap.

5. The cleaning device according to claim 1, wherein the scraping portion further comprises a support body that supports the first scraping member and the second scraping member and that includes a receiving portion that receives the toner that has been scraped off by the first scraping member and the second scraping member.

6. The cleaning device according to claim 5, wherein the support body includes a partition portion that divides a space, where the receiving portion receives the toner, in a direction in which a rotation axis of the roller extends.

7. The cleaning device according to claim 6, wherein the second scraping body covers a part of the space where the receiving portion receives the toner.

8. The cleaning device according to claim 7, comprising:

a housing in which the scraping portion, the guide portion, and the guide support portion are disposed, wherein two ends of the other scraping body are supported by the housing, and a central part of the other scraping body between the two ends is exposed in the housing.

9. The cleaning device according to claim 5, wherein the second scraping member covers a part of the space where the receiving portion receives the toner.

10. The cleaning device according to claim 9, comprising:

a housing in which the scraping portion, the guide portion, and the guide support portion are disposed, wherein two ends of the other scraping body are supported by the housing, and a central part of the other scraping body between the two ends is exposed in the housing.

11. A cleaning device comprising:

a scraping portion whose edge is pressed against a rotational body to which toner adheres and that scrapes the toner off the rotational body;

a guide portion that guides a recording medium toward the rotational body; and a guide support portion that supports the guide portion and that is disposed at a position separated from the scraping portion in a state in which the guide support portion is pressed by the guide portion that is guiding the recording medium, wherein the guide portion is a guide rotational body that guides the recording medium toward the rotational body and that is rotatably supported by the guide support portion.

12. A cleaning device comprising:

a scraping portion whose edge is pressed against a rotational body to which toner adheres and that scrapes the toner off the rotational body;

a guide portion that guides a recording medium toward the rotational body;

a guide support portion that supports the guide portion; and a sandwiched portion that is sandwiched between the scraping portion and the guide support portion and that forms a space between the scraping portion and the guide support portion, wherein the guide portion is a guide rotational body that guides the recording medium toward the rotational body and that is rotatably supported by the guide support portion.

13. A cleaning device comprising:

a scraping portion whose edge is pressed against a rotational body to which toner adheres and that scrapes the toner off the rotational body; and a facing portion that includes a guide portion that guides a recording medium toward the rotational body, the facing portion facing the scraping portion, wherein, in a state in which the guide portion that is guiding the recording medium is pressed, the scraping portion and the facing portion are disposed at positions that are separated from each other, wherein the guide portion is a guide rotational body that guides the recording medium toward the rotational body and that is rotatably supported by the guide support portion.

* * * * *